US006779461B1

(12) United States Patent
Olson et al.

(10) Patent No.: US 6,779,461 B1
(45) Date of Patent: Aug. 24, 2004

(54) INDUSTRIAL AMMUNITION

(75) Inventors: Douglas D. Olson, Vero Beach, FL (US); Jack D. Dippold, Edwardsville, IL (US); Randant D. Huelsmann, Highland, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 10/088,409

(22) PCT Filed: Sep. 21, 2000

(86) PCT No.: PCT/US00/25866

§ 371 (c)(1),
(2), (4) Date: Mar. 18, 2002

(87) PCT Pub. No.: WO01/22026

PCT Pub. Date: Mar. 29, 2001

Related U.S. Application Data

(60) Provisional application No. 60/155,052, filed on Sep. 21, 1999.

(51) Int. Cl.[7] ..... F42B 5/02

(52) U.S. Cl. ..... 102/439; 102/464; 102/503; 102/531

(58) Field of Search ..... 102/293, 430, 102/431, 432, 438, 439, 464, 444–447, 467–470, 503, 529, 530, 531, 93, 43 D

(56) References Cited

U.S. PATENT DOCUMENTS

| | | | | |
|---|---|---|---|---|
| 18,143 A | | 9/1857 | Greene | |
| 1,974,270 A | | 9/1934 | Guignet | 102/12 |
| 2,190,536 A | * | 2/1940 | Staiger | 86/19.5 |
| 2,313,030 A | | 3/1943 | Tauschek | 42/3 |
| 3,103,883 A | | 9/1963 | Ormanns et al. | 102/39 |
| 3,146,712 A | | 9/1964 | Maurer et al. | 102/41 |
| 3,230,884 A | | 1/1966 | Clas | 102/39 |
| 3,604,355 A | | 9/1971 | Greenlees | 102/39 |
| 3,621,781 A | | 11/1971 | Johnsen | 102/38 |
| 3,818,834 A | | 6/1974 | Baumgartener | 102/41 |
| 3,952,658 A | | 4/1976 | Broyles | 102/40 |
| 4,593,622 A | | 6/1986 | Fibranz | 102/530 |
| 4,681,038 A | | 7/1987 | Washburn | 102/464 |
| 4,809,612 A | | 3/1989 | Ballreich et al. | 102/466 |
| 5,824,944 A | | 10/1998 | Dippold et al. | 102/439 |

FOREIGN PATENT DOCUMENTS

GB 3891 1/1915

OTHER PUBLICATIONS

Karwan, C. *Hollowpoint Bulletless Ammo, Hi–Tech Firearms,* Petersen Publishing Co., (Oct., 1998) pp. 65–68.

* cited by examiner

*Primary Examiner*—Michael J. Carone
*Assistant Examiner*—James S. Bergin
(74) *Attorney, Agent, or Firm*—Wiggin and Dana LLP; Michael K. Kinney; Gregory S. Rosenblatt

(57) ABSTRACT

A projectileless ammunition system (20; 320) includes a metallic case (22; 322). A propellant charge (26; 326) is carried by the case and cover by an over-powder member (24; 324) in the absence of a separate projectile. The ammunition is advantageously used with an industrial ballistic tool operating so that each spent case serves as the effective projectile to be propelled by firing of the next round of ammunition.

16 Claims, 6 Drawing Sheets

INDUSTRIAL AMMUNITION

CROSS-REFERENCE TO RELATED APPLICATION

This is the U.S. National Stage of PCT/US00/25866, entitled "INDUSTRIAL AMMUNITION" filed Sep. 21, 2000 and published in English on Mar. 29, 2001 as WO 01/22026 and claims priority to U.S. Provisional Patent Application No. 60/155,052, entitled "INDUSTRIAL AMMUNITION AND METHOD AND APPARATUS FOR USE THEREOF" filed Sep. 21, 1999.

BACKGROUND OF THE INVENTION (1) Field of the Invention

This invention relates to industrial ballistic tools, and more particularly to ammunition therefor.

(2) Description of the Related Art

Industrial ballistic tools are used in a variety of applications. One common application is the in situ cleaning of kilns, for which the tools are commonly identified as kiln guns. Additional applications lie in the tapping and cleaning of furnaces, the cleaning of copper smelters, the cleaning and clearing of silos, the cleaning of boilers, and the like.

By way of example, rotary kilns, which are used to calcine cement and lime, are typically 3 to 7 meters in diameter and 30 to 150 meters long. Calcining takes place at elevated temperatures, typically in the range of 1100° C. to 1500° C. During the calcining process, because of many processing variables, the product may adhere to the sidewall of the kiln forming a clinker, ring or dam. If this adherent obstruction is not removed, additional product will accumulate, reducing or stopping throughput. Removal of the obstruction is necessary.

It is not economically feasible to stop the kiln to remove the obstruction. Also, considering that the ring may form 5 to 10 meters from the end of the kiln, it is not safe or efficient for an operator to attempt to manually remove the obstruction with a long pole or by like methods. Thus many users of rotary kilns utilize industrial ballistic tools. A tool operator will position the tool in a kiln port and then fire metallic projectiles at the obstruction. Impact of the projectiles with the obstruction removes the obstruction from the sidewall of the kiln. The metallic projectiles are usually formed from lead, a dense material with a relatively low vaporization (boiling) temperature of 1750° C. The lead projectiles knock clinkers from the kiln sidewall and then fall into the kiln and may be vaporized.

Industrial ballistic tools are also utilized by manufacturers of steel, ferrosilicon and other materials. Prior to casting these metals, molten metal is typically contained within an electric furnace sealed by a carbon or clay base plug. Since the molten metal is at a temperature in excess of 2500° C., manual removal of the plug is not feasible. One way that the plug may be removed is with an industrial ballistic tool. A metallic projectile is fired from the industrial ballistic tool to break open the plug, starting the flow of molten metal. To prevent contamination of the metal, the projectile typically is formed of a material such as lead that will vaporize on contact with the molten metal after rupturing the plug.

Due to environmental concerns, lead is being phased out as a projectile material for use with industrial ballistic tools. Zinc and zinc alloys have also been utilized as lead substitutes. Their relatively low density may make them disadvantageous for certain uses. A ballistically stabilized zinc-based projectile is described in U.S. Pat. No. 5,824,944 of Jack D. Dippold et al.

Additionally, when repeated firing heats the tool chamber, the plastic tubes of many existing industrial shells may melt and/or leave a residue. The residue may deleteriously affect the firing of subsequent rounds.

In other fields, so-called "bulletless ammunition" has been developed. Cartridges without bullets or other substantial projectiles have been utilized as "blanks" or to propel grenades and the like. However, U.S. Pat. No. 3,621,781 discloses bulletless ammunition in which the sidewall of a spent cartridge becomes the projectile propelled by the charge of the subsequent cartridge. In the small arms field, substantial developments in such bulletless ammunition technology were made by Douglas Olson. These include use of cut down brass rifle cases as the case/projectile for use in revolvers and autoloaders. These are discussed in Karwan, C. *Hollowpoinp Bulletless Ammo, Hi-Tech Firearms*, Petersen Publishing Co., (October, 1998), pp. 65–68.

BRIEF SUMMARY OF THE INVENTION

Accordingly, in one aspect, the invention is directed to ammunition for use with a discharging apparatus which has a chamber for receiving the ammunition, a muzzle, and a barrel between the chamber and the muzzle. The ammunition includes a case comprising in major part zinc and extending aft-to-fore from a base to a mouth and having interior and exterior surfaces. A propellant charge is carried within the case. An over-powder member cooperates with the case to enclose the propellant charge. The ammunition lacks a projectile within the case in a location effective to be expelled from the apparatus and having a mass in excess of a mass of the case.

In various implementations, the case may be a unitary casting of a zinc alloy. The case exterior surface may have at least eight circumferential grooves, the grooves occupying a total of at least about 25% of a length of the case. The plurality of grooves may have widths of between 0.9 mm and 1.8 mm, peak depths of between 0.08 mm and 0.30 mm from a maximum case diameter and, along with interspersed ungrooved areas, extend along at least 70% of the case length. The peak depths may be between 0.13 mm and 0.23 mm and the widths between 1.1 mm and 1.5 mm. The interspersed ungrooved areas may have diameters within 0.05 mm of the maximum case diameter. The ammunition may be combined with an industrial ballistic tool barrel having rifling with a land-to-land diameter which is 0.943–0.950 in. (2.395–2.413 cm) and a groove-to-groove diameter which is 0.954–0.960 in. (2.423–2.438 cm). The case exterior surface may have a circumferential extractor groove having a depth of at least 1 mm and separated by no more than 2 mm from an aft extremity of the case. The ammunition may further include a primer. The primer may comprise a metallic cup mounted in the case base. The primer maybe a #209 primer. The case may have a mass of between 70 g and 10 g, a length of between 50 mm and 65 mm, and a maximum diameter of between 20 mm and 26 mm. The over-powder member may be a plug or it may be a cap which extends from a rear rim to a front end and has a rear portion encircling a fore portion of the case. The cap may be formed of a resinous polymer. The case fore portion may include a flange having an external flange diameter. The cap rear portion may include an inwardly directed part aft of the flange and having an external diameter less than the flange diameter so as to cooperate with the flange to resist forward translation of the cap relative to the flange. A cap length may be between 100% and 3000% of a case length. There may be a first radial clearance of at least 1.0 mm between the flange and the cap. There may be a second radial clearance of between interference fit and 0.5 mm between the cap inwardly directed part and a neck portion of the case aft of the flange.

In another aspect, the invention is directed to ammunition for use with a discharging apparatus including a chamber for receiving the ammunition, a muzzle, and a barrel between the chamber and the muzzle. The ammunition extends from a rear end to a front end and includes a metallic case. The case extends aft-to-fore from a base at the ammunition rear end to a mouth and has interior and exterior surfaces. A cover is formed of a polymeric resin and extends from a rear rim to a front end at the ammunition front end. The cover has a mass not in excess of the mass of the case and has interior and exterior surfaces. The ammunition further includes a propellant charge advantageously confined within at least one of the case and cover.

In various implementation, the case may have a central longitudinal channel extending forward from the primer pocket at the base to a fore portion proximate the mouth. A primer may be mounted within the primer pocket. The propellant charge may be confined within a volume at least partially defined by the central longitudinal channel and the cover interior surface. The cover may have a cover length and the case may have case length less than the cover length. The cover may consist essentially of injection molded high density polyethylene and the case may consist essentially of die cast zinc or zinc alloy. The cover interior surface may have a circumferential recess forward of the case and effective to locally weaken the cover. The weakening is sufficient to permit internal pressure within the cover to sever a portion ahead of the recess from a portion behind which remains attached to the case when the ammunition is fired. The recess may have a longitudinal extent of between 1 mm to 5 mm and may locally thin the cover to a minimum thickness of between 0.6 mm and 1.4 mm from an adjacent thickness of between 1.6 mm and 2.6 mm. The case may have a mass of between 70 g and 10 g, a length of between 30 mm and 40 mm, and a maximum diameter of between 20 mm and 26 mm. The case exterior surface may have a plurality of circumferential grooves, the grooves occupying a total of at least about 25% of a length of the case.

In another aspect, the invention is directed to a method for operating an industrial ballistic tool to discharge a plurality of ammunition rounds. A plurality of ammunition rounds are provided each comprising a zinc case and a charge of propellant. A first such round is inserted into a chamber of the tool. Ignition of the charge of the first ammunition round is caused. A second such ammunition round is inserted into the chamber. Ignition of the charge of the second ammunition round is caused so as to expel the spent case of the first ammunition round out of the muzzle at an effective muzzle kinetic energy.

In various implementation of the invention, the second round insertion and ignition may be repeated, each time utilizing a new ammunition round to expel the case of the previously-discharged round. Prior to insertion of the first round, a chargeless case may be inserted into the chamber so that the insertion of the first round advances the chargeless case toward the muzzle. Prior to insertion of the first round, a preliminary round may be inserted into the chamber. The charge of the preliminary round may not be ignited and insertion of the first round advances the preliminary round toward the muzzle. Alternatively, the charge of the preliminary round may be ignited and insertion of the first round advances the spent case of the preliminary round toward the muzzle. The muzzle kinetic energy may be at least 10 kJ. Insertion of the second round may include engaging an aft end of the spent case of the first round with a fore end of the second round so as to advance the spent case toward the tool muzzle. The ignition of the charge of the second ammunition round may include permitting a first portion of a non-metallic cover portion of the second ammunition round to separate from a remaining second portion and travel behind the spent case of the first ammunition round. This may further comprise permitting the remaining second portion to seal against the chamber to resist combustion gas leakage around the case of the second round.

The present invention may facilitate a number of advantages over prior art slugs. A key potential advantage is cost. Beyond manufacturing cost, costs of collection and disposal of spent hulls is eliminated. Another advantage is that use of a metal case does not entail the melting associated with plastic tubes of conventional industrial ammunition. This may increase reliability.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
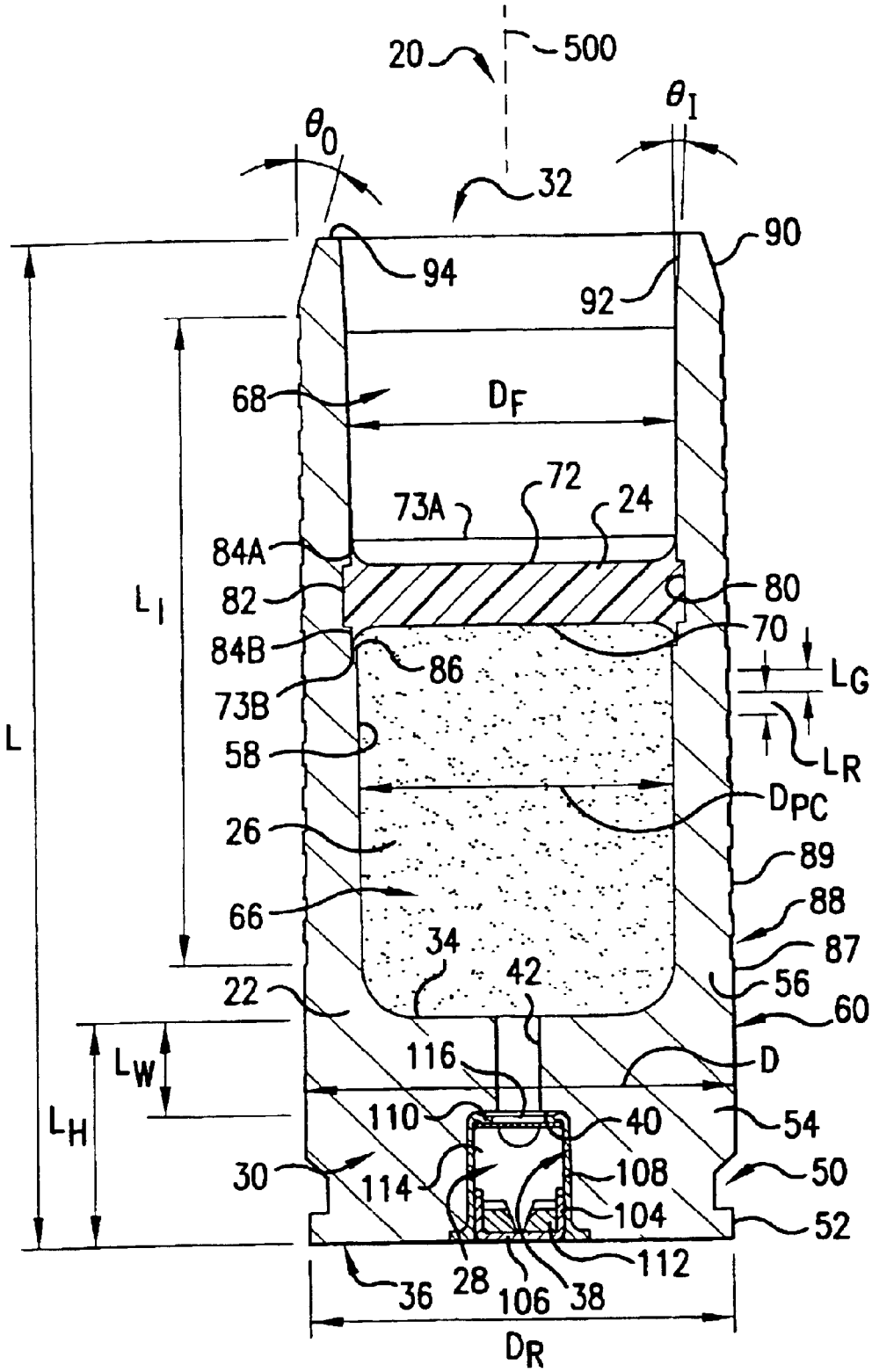
FIG. 1 is a longitudinal cross-sectional view of an ammunition round according to principles of the invention.

The term "ammunition" "round of ammunition", "ammunition cartridge" and the like are commonly associated with a self contained combination of a projectile and propellant, typically with a case for containing the propellant and holding the projectile and a primer for igniting the propellant. When typical ammunition is utilized, the propellant charge of a given round expels the projectile of that round and the spent case is then extracted and replaced with a fresh round. For convenience, terms such as "round" or "cartridge" may be utilized to describe the ammunition of the present invention, even though the rounds do not provide the projectile and propellant for a given firing but, rather, the propellant for one firing and the projectile for the next FIG. 1 shows a projectile cartridge 20 including a case 22, a wad 24, a propellant charge 26, and a primer 28. In the prototype embodiment, the case is unitarily formed of machined zinc, although cast zinc is preferred for production, and is symmetric about a central longitudinal axis 500. Other metals, including cast and wrought metals, may be employed. The case extends along the axis 500 from a head 30 at an aft end to a mouth 32 at fore end. The head has fore and aft surfaces 34 and 36. A largely cylindrical primer pocket surface 38 extends forward from the aft surface 36 and terminates at a substantially annular base surface 40. The base surface and primer pocket surface define a primer pocket having a diameter effective to accommodate the primer 28 in a press fit relation, a fore end of the primer abutting the surface 40 and an aft end substantially flush with the aft surface 36. A cylindrical flash hole surface 42 extends forward from the base surface 40 to the fore surface 34 to define a flash hole or venting between the primer pocket and the case interior.

The head includes an extractor/retention groove 50 which separates a rim portion 52 of the head from a web portion 54 of the head and a case body 56. The body has an interior surface 58 which merges with the fore surface 34 of the head to form the case interior surface. An exterior lateral surface 60 of the head and body forms a substantial portion of the case exterior surface.

Internally, the case interior is divided into two volumes 66, 68 by the wad 24: an aft volume or powder (propellant) chamber 66 between the fore surface 34 and an aft surface 70 of the wad; and a forward volume 68 ahead of a fore surface 72 of the wad. With the exception of various relieved areas identified below, the surface 60 is substantially cylindrical, having a diameter D. Along a major portion of the powder chamber, the interior surface 58 has a diameter $D_{PC}$. Along a major portion of the forward volume 68, the interior surface has a diameter $D_F$ which is preferably greater than $D_{PC}$ so that the wall thickness of the body is smaller along the forward volume than along the powder chamber.

To secure the wad 24 within the case, an annular internal channel or recess 80 in the body 56 receives an annular projection 82 of the wad. Cylindrical surfaces 84A and 84B on fore and aft sides of the projection 82 engage the surface 58 to provide a seal between the wad and the case. Immediately aft of the surface 84B, the case includes an annular shoulder 86 which divides the portions having respective diameters of $D_F$ and $D_{PC}$.

Ahead of the extractor groove 50, the exterior lateral surface 60 has an uninterrupted cylindrical portion 87. Ahead of the uninterrupted portion are a series of grooved portions (grooves) and ungrooved portions (ribs/lands) extending over a total length $L_1$. In the illustrated embodiment, the grooves 88 each have a length $L_G$ while the ribs 89 each have a length $L_R$ which are of similar magnitude. The groove depth is advantageously smaller than these lengths. At the fore end of the case, the exterior and interior surfaces are chamfered at respective angles $\theta_0$ and $\theta_1$ with a flat annular rim 94 therebetween at the case mouth defining frustoconical exterior and interior surface portions 90 and 92.

The preferred primer is a conventional No. 209 shotshell primer or equivalent which includes a forward-facing primer cup having a generally cylindrical sidewall 104 and a web 106 spanning the sidewall and forming an aft end of the primer cup. The primer further includes an aft-facing battery cup having a generally cylindrical sidewall 108 and a web 110 spanning the sidewall at the forward end thereof to define a forward end of the battery cup and primer. The primer cup is press fit within the battery cup adjacent the aft end thereof thus closing the otherwise open aft end. The battery cup is press fit within the head 30 engaging the primer pocket surface 38. Proximate a rim at its aft end, the sidewall 108 is flared outward.

The primer cup contains a primer charge 112 which may be covered by a foil or other layer and may preferably have a lead-free, dinol-based composition. An aft-facing anvil 114 has a base held by the battery cup and a tip extending centrally into the primer cup proximate the primer charge. A circular flash hole 116 is located centrally within the web 110 to provide flash venting extending from the interior of the battery cup to the powder chamber 66. When the primer cup is struck via a firing pin, forward deformation of the web 106 causes the primer charge to impact the anvil tip igniting the primer charge. The ignited primer charge is vented through the flash hole 116 to ignite the propellant 26. In the exemplary embodiment, the flash hole 116 is a single circular aperture having a diameter roughly equal to or in excess of the 0.095 inch (0.24 cm) diameter typical in a No. 209 shotshell primer. In the exemplary embodiment, the base of the anvil has a forward-facing concavity overarching the flash hole. In the exemplary embodiment, the primer has an overall length of about 0.3 inch (0.76 cm) and the battery cup sidewall outer surface has a diameter about 0.24–0.25 inch (0.612–0.635 cm) and preferably of about 0.241–0.245 inch (0.612–0.622 cm) along a major portion surrounding the primer cup. The flaring of the aft end of the battery cup produces a local diameter of about 0.3–0.32 inches (0.76–0.81 cm). Specifically, a forward portion of the battery cup extending along a length of about 0.15–0.16 inch (0.38–0.41 cm) has an predominate external diameter of about 0.241 inch (0.612 cm). The battery cup, having a generally uniform wall thickness of about 0.02 inch (0.051 cm) expands slightly behind the forward section to form a pocket for receiving the primer cup. In this area surrounding the primer cup, the battery cup has a predominate external diameter of about 0.245 inch (0.622 cm) until flaring outward at the aft end.

Figure 2:
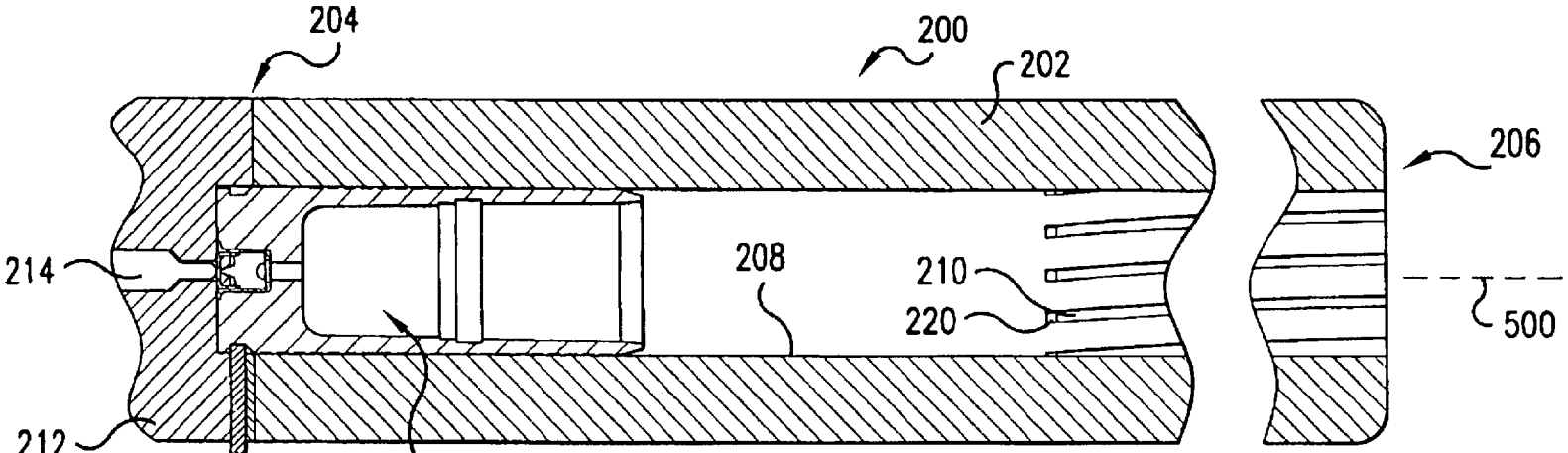
FIG. 2 is a semi-schematic longitudinal sectional view of a spent round in the chamber of an industrial ballistic tool.

FIG. 2 schematically illustrates a tool 200 for discharging the inventive ammunition. The tool has a barrel 202 extending along a central longitudinal axis coincident with the projectile axis 500 from a breech end 204 to a muzzle 206. The barrel bore 208 includes rifling 210 extending from a location ahead of the breech to the muzzle. A chamber area 211 extends forward from the breech end. A bolt 212 is shown in a closed position at the breech and carries a firing pin 214 and a retention/extraction member 216. FIG. 2 also shows a spent case 22' positioned in the chamber. The member 216 extends into the extractor groove of the case 22' and its aft surface engages the aft surface of the extractor groove to prevent forward movement of the spent case.

Figure 3:
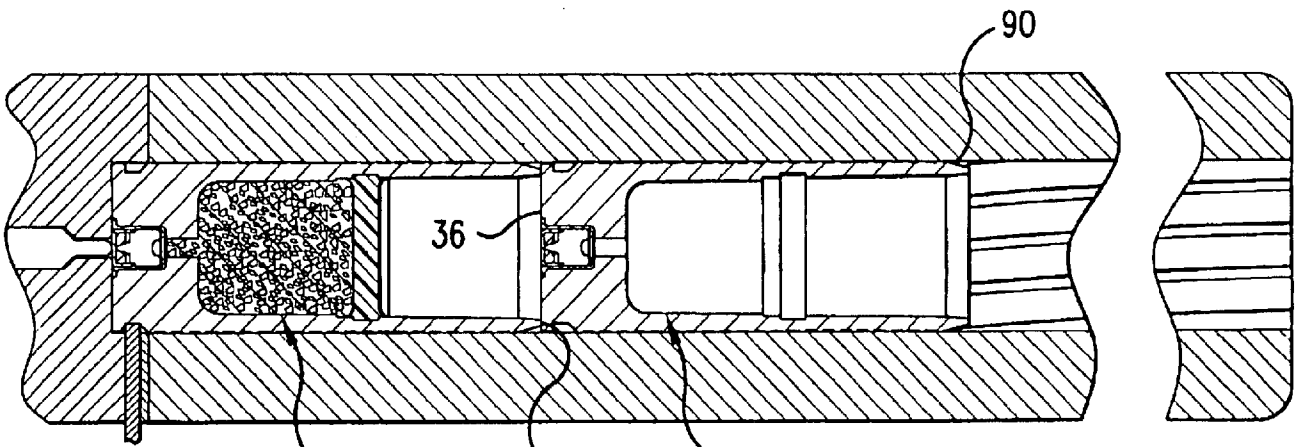
FIG. 3 is a semi-schematic longitudinal cross-sectional view of a loaded round in the chamber of the tool with the spent round advanced tandemly ahead.

To load a fresh round, the member 216 is withdrawn from the extractor groove, decoupling the spent case from the bolt, and the bolt is withdrawn rearward to an open position (not shown). A fresh round 20 is then fed behind the chamber and driven into the chamber by the bolt 212. A variety of known feed mechanisms may be utilized including various actions and magazines. The insertion of the round 20 into the chamber brings the forward rim 94 of the round into contact with the aft surface 36 of the head of the spent case 22'. The insertion thus drives the spent case from its former chambered or "firing" position of FIG. 2 to a second, "projectile," position of FIG. 3. In the projectile position, the mouth of the spent case is advantageously very close to the aft end of the rifling. In the exemplary embodiment, each land of the rifling includes a bevel 220 at its aft end which provides a transition from the barrel diameter $D_G$ along the chamber and grooves and $D_L$ along the remaining portion of the lands. In the illustrated embodiment, these bevel surfaces are located adjacent the chamfered surface portion 90 of the spent case in the projectile (FIG. 3).

Figure 4:
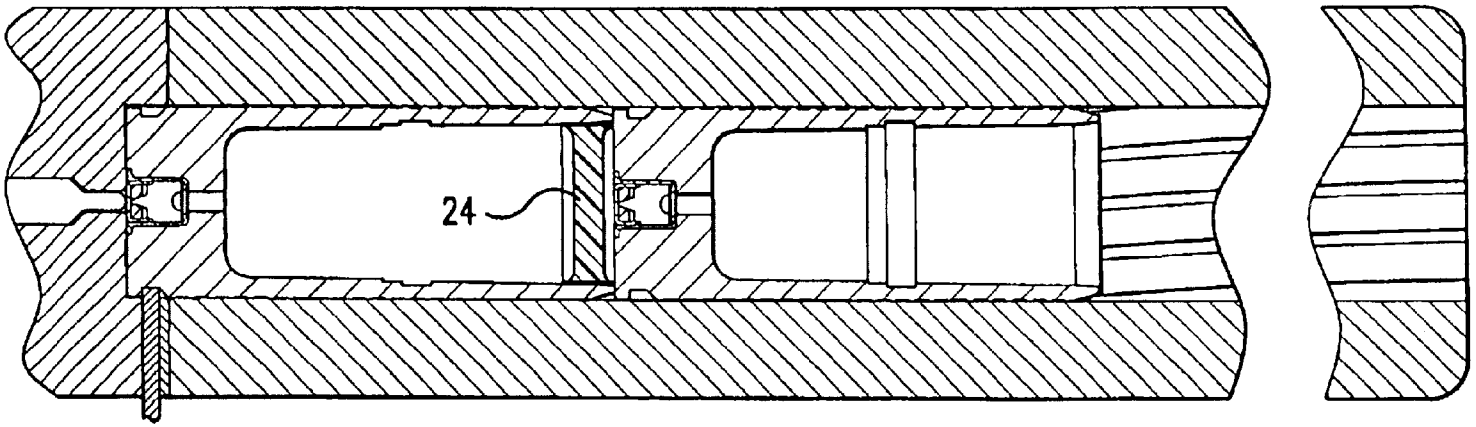
FIG. 4 shows the round and spent case of FIG. 3 shortly after the round is fired.

With the member 216 engaged to the round 20, the pin 214 carried within the bolt 212 is driven forward and strikes the aft surface of the web 106 of the primer cup. The engagement between the member 216 and the round 20 prevents the firing pin impact from driving the round 20 forward without igniting the primer. The impact deforms the web forward and drives the primer charge against the anvil, igniting the primer charge. Hot combustion gases and flames from the burning primer are vented through the flash holes of the battery cup and case and into the propellant chamber 66 whereupon they ignite the propellant. Combustion gases generated by the burning propellant raise the pressure within the propellant chamber sufficiently to drive the wad 24 out of engagement with the channel 80, driving the wad through the forward volume 68 toward the spent case (FIG. 4).

Figure 5:
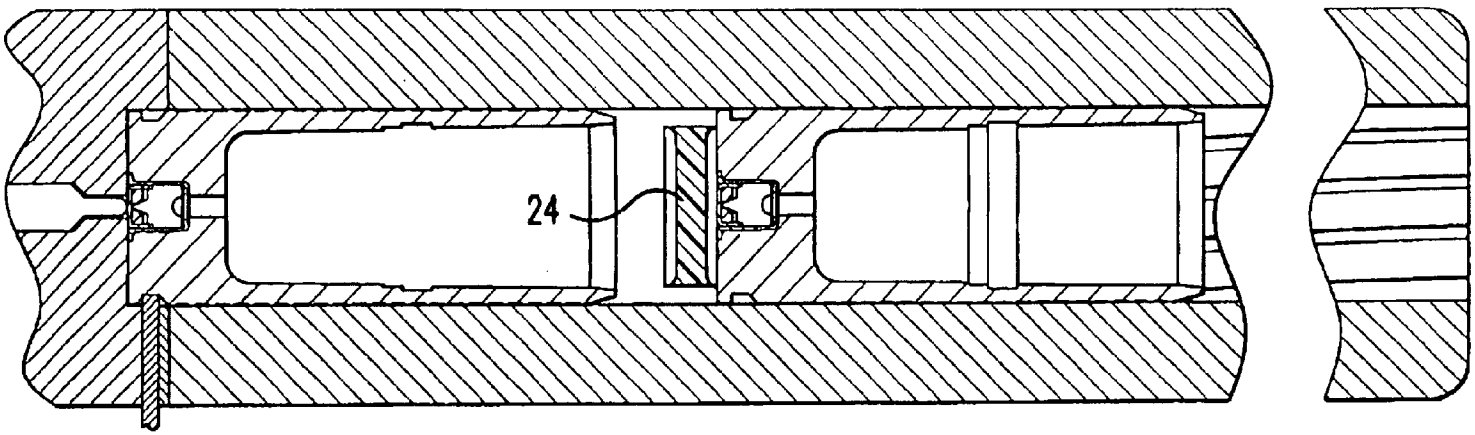
FIG. 5 shows the round and spent case of FIG. 4 as the spent case advances down the tool barrel.

The wad 24 is driven into engagement with the aft surface 36 of the head of the spent case. Pressure from the combustion gases compress the wad against the spent case. Under such pressure, the wad deforms radially outward so that its circumferential perimeter bears against and obturates the barrel to prevent flow of combustion gas ahead of the wad and thus around and ahead of the spent case/projectile. Expanding combustion gases then propel the wad 24 and spent case/projectile down the barrel (FIG. 5) and expel them from the muzzle. An additional role of the wad may be to shield the primer cup of the spent case/projectile from the combustion gases. Otherwise, the primer cup might not be able to withstand the pressure and could rupture, allowing the combustion gases to flow into the spent case/projectile and, thereby, reduce the net force applied to the spent case/projectile.

The process may then be repeated. Optionally, if no spent case is initially present, an unspent round may be inserted into the chamber and then driven forward to the projectile position by a second unspent round and launched. Additionally, if it is desired to remove a spent or unspent round from the chamber (such as for tool servicing or to remove a misfired round), the member 216 is left in place as the bolt is withdrawn and the case or the round ejected as with conventional ballistic tools and firearms.

An alternative method of operation involves advancing the spent case from the chambered position to the projectile position prior to insertion of the next round. This can be accomplished, for example, by a piston mounted within the bolt. This mode of operation reduces the insertion force required to insert the unspent round.

A preferred case material is zinc alloy AG40A, having nominal composition by weight: Cu 0.25% max; Al 3.5–4.3%; Mg 0.020–0.05%; Pb 0.005% max; Cd 0.004% max; Sn 0.003% max; and balance Zn. Other alloys may, however, be utilized. Conventional die casting techniques may be utilized. Other manufacturing techniques, e.g., semi-solid casting (rheocasting or thixocasting), nucleated casting, and slush casting may be utilized.

Conventional eight-gauge industrial ballistic tools have a bore diameter (groove-to-groove if rifled) of about 0.830+0.05 in. (2.11+0.13 cm). An 8-gauge version of the present ammunition might risk accidental attempts to use conventional ammunition in a tool configured for the inventive round or vice versa Also, such a size would present difficulties in providing the desired 3 oz. (85 g) case weight. Accordingly, the case is dimensioned for use with a barrel having significantly larger land and groove diameters. With such a barrel, the presently preferred land-to-land diameter is 0.946 in. (2.403 cm) while the preferred groove-to-groove diameter is 0.958 in. (2.433 cm). These larger dimensions allow the case to meet the weight goal while having appropriate wall thickness, powder chamber volume, and volume ahead of the wad. The case diameter also defeats attempts to use the preferred inventive ammunition in conventional tools and vice versa. For such barrel dimensions, a particularly preferred case diameter D is 0.95–0.958 in. (2.428–2.433 cm). This provides the maximum case diameter along the uninterrupted portion 87 and along the ribs 89. This diameter is effective to allow the associated portions to be engraved by the rifling to induce spin and to obturate with the remaining bore surface. In the absence of the grooves 88, the drag forces between the barrel and case/projectile would be excessive, causing loss of muzzle velocity, and undue barrel wear and heating. The rounds, however, may also be utilized with smoothbore tools with or without rifled extensions.

A number of factors go into the selection of the geometry and dimensions of the grooves and ribs. The greater the total length of the relieved areas (and thus the lesser the areas at or substantially at the diameter D), the lower the frictional drag from engagement with the barrel. Because of the effect of chamber pressure, the length of any given groove should not be so great that the chamber pressure can cause the case body to buckle outward along such area Similarly, the length of each of the interspersed ribs should not be so small that the chamber pressure can cause a crushing of such ribs which would, thereby, also drive the grooved areas radially outward. The groove depths should be sufficient for the friction reduction but not so large as to either weaken the body and allow the aforementioned bowing out or unduly decrease the case mass which is important for maintaining the desired kinetic energy. These factors lead to the arrangement of ribs and grooves over a substantial length of the case. The exemplary ribs and grooves each have lengths of 0.050+/−0.005 in. (0.127+/−0.013 cm) and commence at a distance of 0.625+/−0.005 in. (0.159+/−0.013 cm) from the aft extremity of the aft surface 36 and extend all the way to the exterior chamfered surface portion 90.

For the chamfered surface portions 90 and 92, particularly preferred angles $\theta_O$ and $\theta_1$ are 15°+/−1° and 5°+/−0.5°. The chamfered surface portion 90 preferably extends along a length of at least about 0.1 in. (0.25 cm) to provide a degree of improved aerodynamics as well as to facilitate chambering of the rounds. Such length may be affected by whether the surface portion 90 meets a groove or a rib, a preferred length being between about 0.125 in. (0.318 cm) and about 0.16 in. (0.406 cm). The angle $\theta_1$ is effective to ease insertion of the wad 24 through the case mouth but chosen to not unduly thin the case at the mouth or unduly constrain the length of the exterior chamfered surface portion 90.

Additionally, in the exemplary embodiment the case rim 52 may be slightly rebated (e.g., to an exemplary rim diameter similar to the diameter of the grooves 88). The extractor/retention groove 50 is, clearly, further relieved, for example to a diameter of 0.845–0.850 in. (2.145–2.159 cm), its aft surface being substantially radial and its fore surface being frustoconical, e.g., at a cone angle of about 45°, leaving a cylindrical portion in between of about 0.085–0.090 in. (0.216–0.219 cm) in length. An exemplary rim thickness or length is 0.072–0.078 in. (0.183–0.198 cm).

The wad 24 serves to encapsulate the propellant within the powder chamber. The wad should have sufficient robustness to do this throughout an anticipated range of handling conditions. It is also desirable that the wad, and its engagement to the case, be sufficiently robust to allow a moderate increase in chamber pressure when the round is fired and before the wad is driven forward. The wad should be sufficiently thin and, thereby, leave the forward volume 68 with a sufficient length to yield lower peak chamber pressures than would be present if the wad extended all the way between the powdered chamber and the mouth. The wad should also be lightweight, to avoid detracting from the kinetic energy imparted to the spent case/projectile. Accordingly, the exemplary wad is molded of a plastic material polyethylene, preferably low density polyethylene (LDPE) is believed to provide an advantageous combination of strength and formability for the wad. To further reduce weight relative to its sealing capability, the fore and aft surfaces 72 and 70 are formed with a central depression, being flat nearly all the way to the outer periphery of the wad and having a fillet-like transition to the associated rim 73A, 73B of near vanishing thickness.

As noted above, the dimensions of the forward volume 68 are particularly relevant to controlling peak chamber pressure. Both volume and length may be relevant parameters. The volume of the propellant chamber will largely be constrained by the required amount of propellant. For an exemplary case having a mass of 3.0 oz. (85 g), an exemplary propellant charge is 93 grains (6.0 g) of OBP615 BALL POWDER propellant available from Olin Corporation, East Alton, Ill. under license from Primex Technologies, Inc., St. Petersburg, Fla. For such a charge, a propellant chamber volume in the vicinity of or somewhat greater than 0.3803 in.$^3$ (6.24 cm$^3$) is preferred. A number of factors will ultimately influence the desired case length, wall thickness, and thus the size of the forward volume 68. The length has an influence on aerodynamics and the wall thickness (by effecting the amount of the remainder of the weight which is found in the case head) influences balance. Both aerodynamics and balance may affect ballistic performance. The case length and wall thickness also influence impact performance. A relatively long case wall may be more likely to deform upon impact. This deformation may reduce the impact shock of the projectile, thus reducing its usefulness for many applications. The deformation may also help deflect the projectile, potentially also reducing effectiveness. With the foregoing in mind, it is believed that a thin, short sidewall is advantageous for many industrial applications. This maximizes the mass represented by the head. If the sidewall is sufficiently thin to be easily deformed by the impact, such deformation will absorb a relatively small amount of energy. The remaining energy of the head impacting the target will still be effective for the intended purpose.

The dimensions of the forward volume 68 are, however, also relevant to controlling peak chamber pressures. For a given projectile mass, various different muzzle velocities may be desired for various different applications. The different applications may entail use of different amounts of propellant and/or propellant types (bum rates). It is believed that for most, if not substantially all, applications, a relatively small forward volume will be sufficient for chamber pressure control and thus desirable due to the impact-enhancing advantages of the short projectile length associated with the small forward volume. It is theorized that a forward volume having a length as little as 0.05 inches should be sufficient to provide chamber pressure control adequate for a ballistic tool used in applications for which present eight-gauge are effective. Thus an appropriate goal for the length of such forward volume would be in the vicinity of about 0.05 inch to about 0.1 inch. Depending on wall thickness, with such a relatively small forward volume the overall case length could be in the range of about 1.5 inches to about 1.75 inches. For such a case, the head length $L_H$ and the length $L_W$ of the flash hole surface 42 and center of the web portion 54 will both be increased by about 0.2 inch to 0.4 inch above the exemplary prototype dimensions of 0.50 inch and 0.195 inch respectively. Another envisioned modification is an alteration of the diameter of the flash hole surface 42 from the prototype dimension of 0.10 inch. A decrease in this diameter (e.g., toward 0.80 inch) has an advantage of concentrating mass at the head. If the diameter is too small, primer recoil might occur. Given the length $L_W$, a significant amount of propellant may be contained within the flash hole surface 42 (which thus serves as a flash tube). A larger diameter and its associated larger amount of propellant may lead to more rapid ignition of the main body of propellant within the powder chamber. Thus a smaller diameter may be advantageous if a less rapid ignition is desired, for example, to help control peak chamber pressures.

Figure 6:
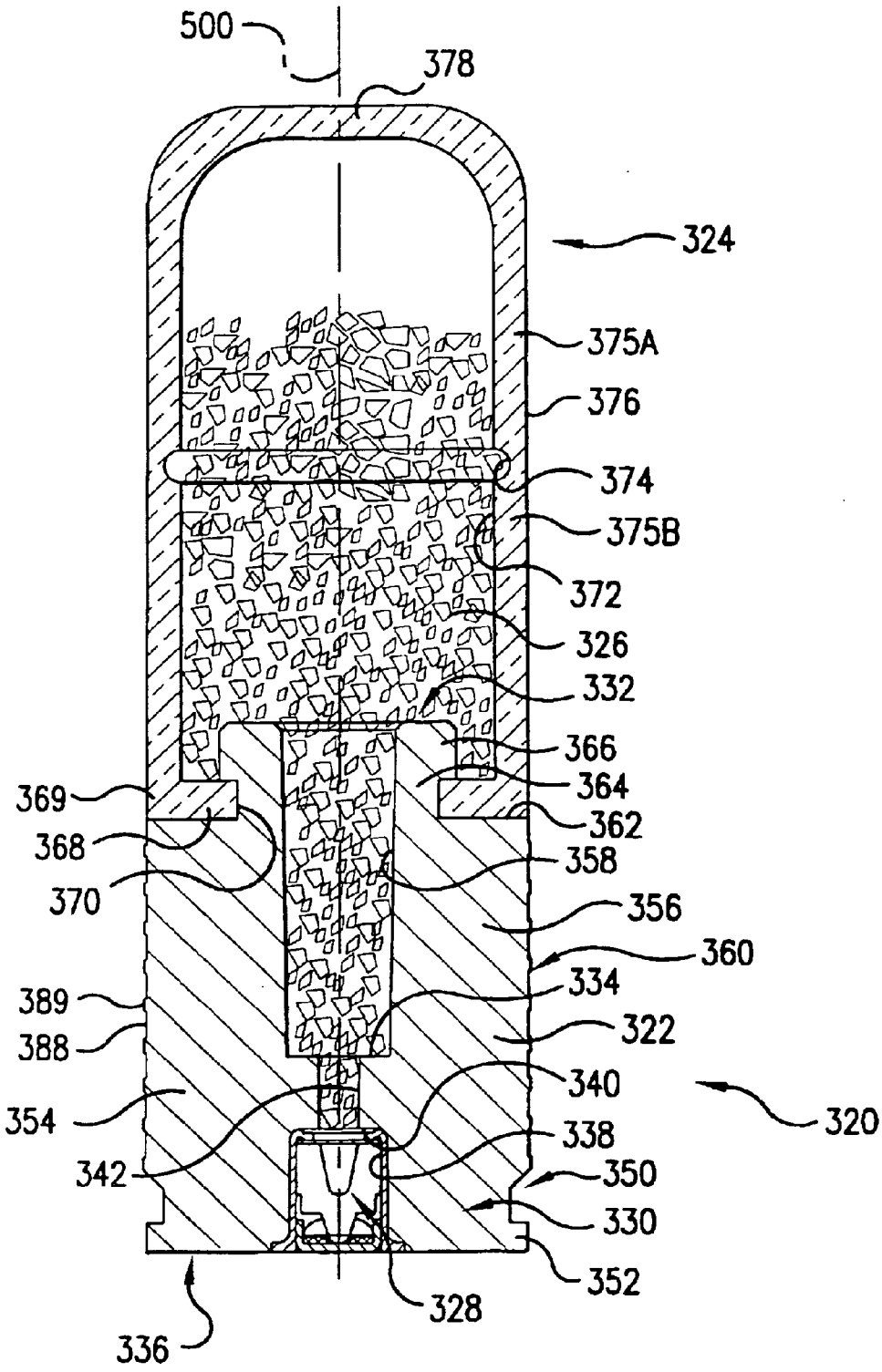
FIG. 6 is a longitudinal cross-section view of a second ammunition round according to principles of the invention.

FIG. 6 shows an alternate cartridge 320 including a case 322, a cover 324, a propellant charge 326 and a primer 328. Subject to the discussion below, various properties and dimensions of the cartridge 320 may be the same as or similar to those of the cartridge 20 of FIG. 1. The case is preferably a one-piece casting of zinc or a zinc-based alloy while the cover is preferably a one-molding of low density polyethylene. The case head 330 may be similarly shaped to the head 30 of the case of FIG. 1, while features proximate the mouth 332 are formed to cooperate with the cover 324. The head has fore and aft surfaces 334 and 336. A primer pocket 338 joined at a base surface 340 to a flash hole surface 342 may be similarly formed to that of the case of FIG. 1. In order to ease manufacturing, the flash hole may preferably have at least a slight (e.g., 1°) fore-to-aft taper. Extractor/retention groove 350, rim 352, and web 354 may be similarly formed to corresponding elements of the case of FIG. 1. The wall thickness of the body 356 is generally greater than that of the case of FIG. 1, with a body interior surface being of relatively smaller diameter while body exterior lateral surface 360 may be of similar diameter. A main portion of the body 356 terminates at an annular forward-facing shoulder 362. A neck 364 extends forward from the shoulder to a flange 366 having a diameter intermediate those of the neck and body main portion. At its forward extremity, the flange is chamferred or bevelled both internally and externally. The body interior surface 358 extends continuously through the flange, neck and main body portion having a fore-to-aft taper. The body interior surface 358 cooperates with the flash hole surface 342 and primer pocket surface 338 to form a central longitudinal channel extending through the case.

The cover 324 includes an inwardly-directed flange 368 at an aft rim 369. An inwardly-facing surface 370 defining a central aperture in the cover flange 368 has a diameter smaller than a diameter of an external cylindrical surface of the case flange 366. This permits the cover flange 368 to be captured between the case flange 366 and the shoulder 362. In the exemplary embodiment, there is a radial gap or clearance between the case flange 366 and the cover interior surface 372 so that the aft surface or underside of the case flange 366 covers and contacts only an inboard portion of a forward facing surface of the cover flange 368. In its installed condition, the cover cooperates with the body interior surface to define a powder chamber containing the charge 326. In the exemplary embodiment, the powder chamber has substantially more volume than is necessary to contain the charge. The charge may be unrestrained within this additional space or an additional member such as a wad may be located within the cover to further confine the charge.

At an intermediate position along the length of the cover, the cover is locally weakened such as by provision of an annular channel 374 in the interior surface 372. The channel 374 divides fore and aft portions 375A and 375B of the cover 324. An exemplary channel 374 is formed as a full radius channel having a depth half its longitudinal extent. The cover exterior surface 376 is generally cylindrical from the rim 369 forward to a rounded transition (e.g., I/O radius of 0.25 in.(0.64 cm)) to a flattened front end 378.

The case exterior surface 360 is advantageously provided with an alternating series of grooves 388 and ribs 389.

| Dimension | Value (in. (cm) unless noted) |
|---|---|
| Rim diameter | 0.937 – 0.003 (2.380 – 0.008) |
| Rim length | 0.075 – 0.003 (0.191 – 0.008) |
| Extractor groove base diameter | 0.850 – 0.005 (2.16 – 0.013) |
| Extractor groove base length | 0.085 + 0.005 (0.216 + 0.013) |
| Neck length | 0.100 + 0.005 (0.254 + 0.013) |
| Neck diameter | 0.500 +/– 0.003 (1.27 +/– 0.01) |
| Case flange length | 0.250 +/– 0.005 (0.635 +/– 0.013) |
| Case flange diameter | 0.588 +/– 0.003 (1.494 +/– 0.008) |
| Case flange I/O chamber | 0.02 (0.05) × 45° |
| Head fore surface diameter | 0.240 +/– 0.005 (0.610 +/– 0.013) |
| Case interior taper | 2° +/– 10' |
| Rib and groove pitch | 0.100 (0.254) |
| Rib length | 0.032 +/– 0.005 (0.081 +/– 0.013) |
| Maximum case (rib) diameter | 0.955 – 0.003 (2.426 – 0.008) |
| Groove diameter | 0.944 – 0.004 (2.395 – 0.010) |
| Overall length | 2.938 (7.463) nominal |
| Case length | 1.363 +/– 0.003 (3.462 +/– 0.008) |
| Cover length | 1.825 +/– 0.050 (4.636 +/– 0.127) |
| Cover outer diameter | 0.943 +/– 0.005 (2.395 +/– 0.013) |
| Cover principal inner diameter | 0.780 +/– 0.010 (1.981 +/– 0.254) |
| Cover flange thickness | 0.100 +/– 0.005 (0.254 +/– 0.013) |
| Cover flange inner diameter | 0.500 +/– 0.003 (1.270 +/– 0.008) |
| Cover groove depth | 0.040 (0.102) |
| Flash hole length | 0.50 (1.27) |
| Flash hole diameter | 0.10 (0.25) |
| Case mass | 3.00 +/– 0.01 oz. (85.0 +/– 0.3 g) |
| Cover mass | 6.5 +/– 0.1 g |
| Propellant charge | 90 grains (5.8 g) |

Relative to the cartridge 20, the foregoing dimensions provide the cartridge 320 with both a smaller maximum diameter and a smaller total length of material at that maximum diameter. This reduces barrel wear and the required insertion force to chamber a round and drive a spent round forward into the projectile position.

Figure 7:
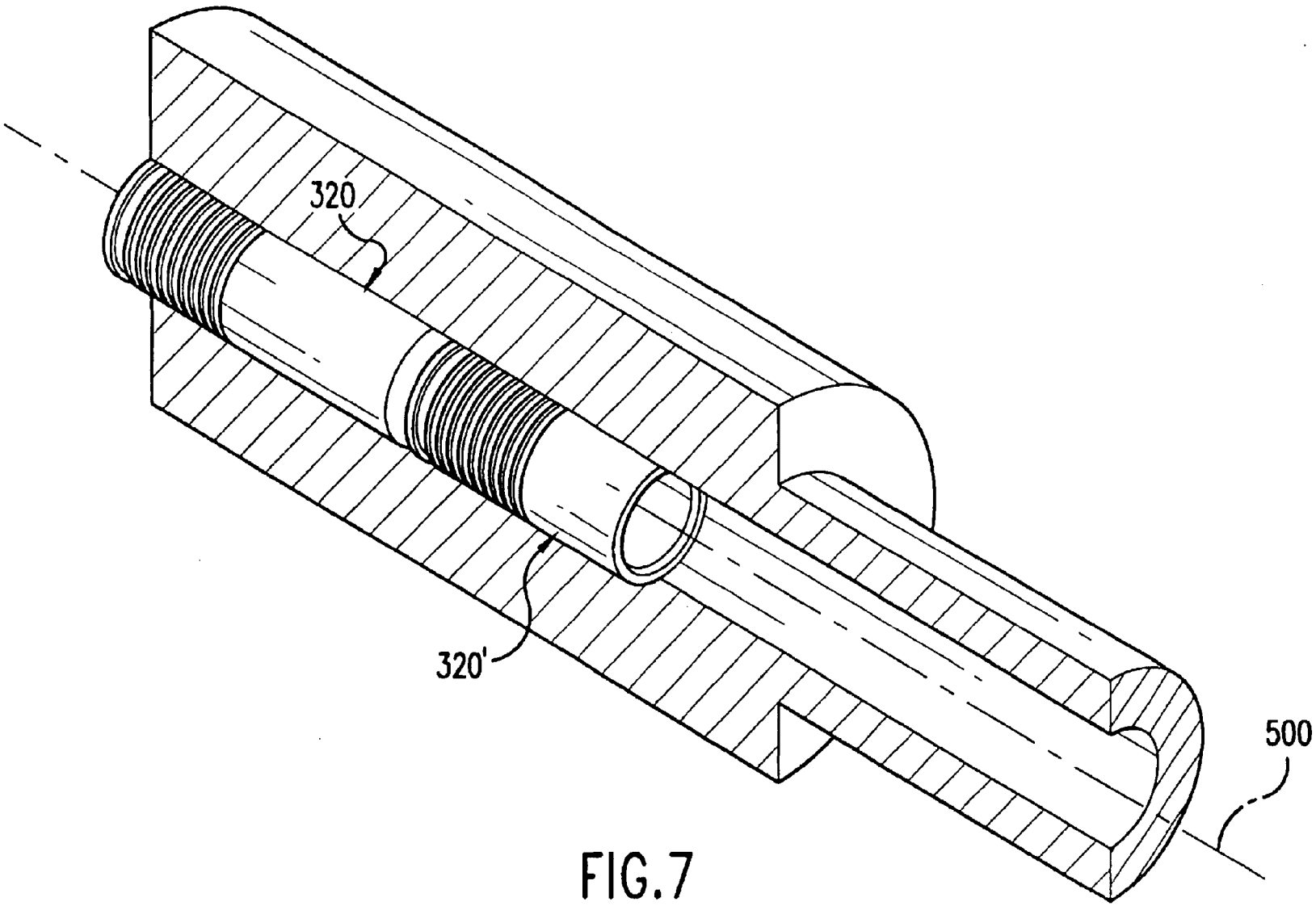
FIG. 7 is a semi-schematic cut-away view of the round of FIG. 6 in the chamber of the tool with a spent round advanced tandemly ahead.
Figure 8:
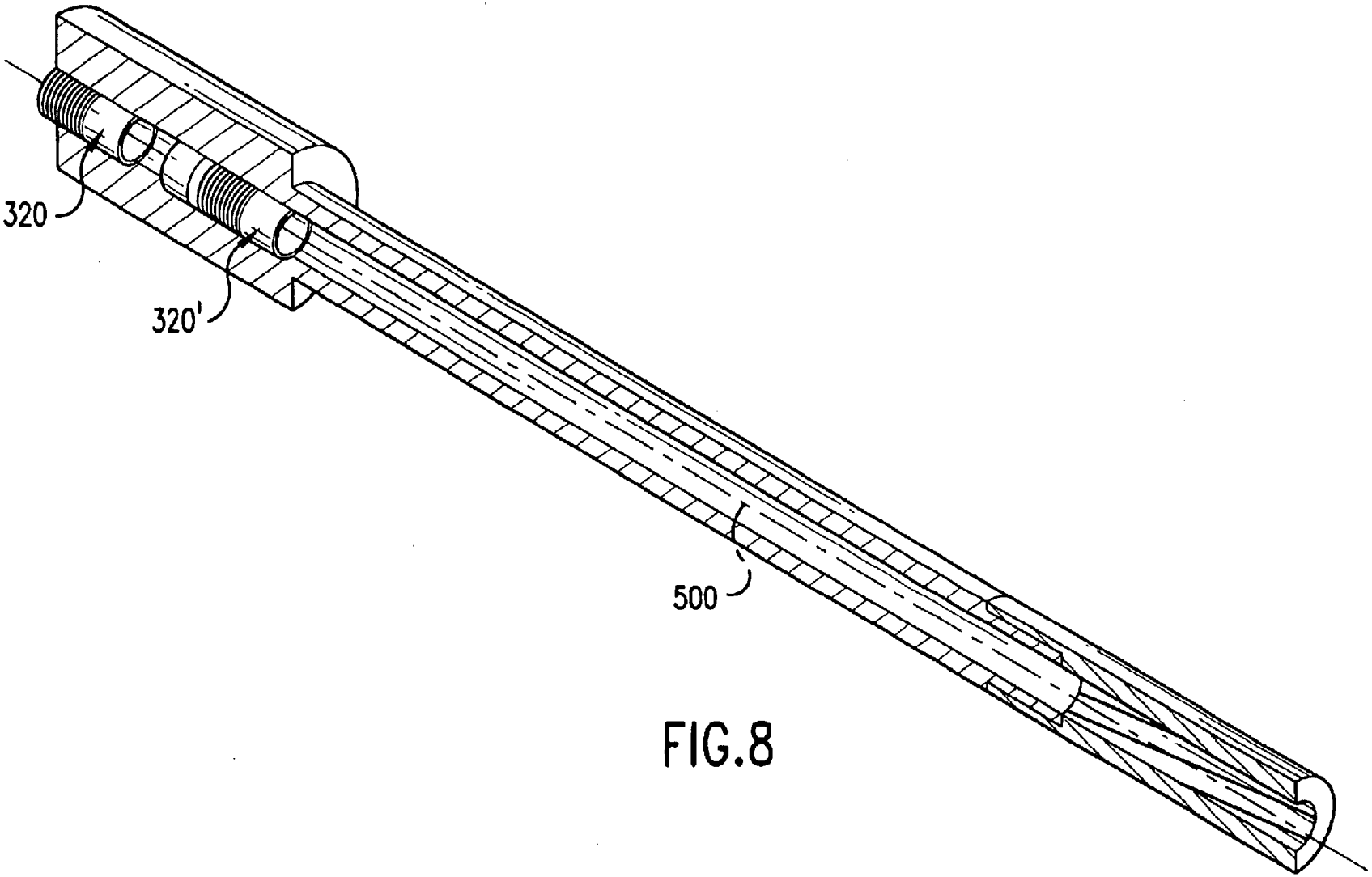
FIG. 8 shows the round and spent round of FIG. 7 shortly after the round is fired. Like reference numbers and designations in the various drawings indicate like elements.

Various parameters of use of the cartridge of FIG. 6 may be similar to that of the cartridge of FIG. 1 and are not repeated in detail. However, FIG. 7 shows an unfired cartridge 320 chambered behind a spent cartridge 320' analogous to the illustration of FIG. 3. The spent cartridge comprises the case, spent primer, and aft portion of the cover of the previously-fired round. When the cartridge 320 is fired, pressure increases within its cover. The pressure increase is effective to rupture the cover at the channel 374 separating the fore cover portion from the aft cover portion (FIG. 8) and permitting expanding gas to drive the fore portion along with the spent cartridge ahead down the barrel. The fore cover portion can provide a significant degree of obturation, significantly preventing combustion gasses from passing around the spent case/projectile. This, in large part, facilitates a relatively low maximum case diameter and a relatively low portion of material at that maximum diameter by reducing the need for the case/projectile to obturate itself.

Additionally, the aft cover portion helps prevent combustion gasses from flowing back around the case being fired. The presence of the radial gap between the case flange 366 and cover interior surface 372 permits combustion gas pressure to act on the adjacent portion of the fore surface of the cover flange 368 pressing the aft surface thereof into firmer engagement with the case shoulder surface 362 to resist infiltration of combustion gasses between the cover and case and thereby around the case.

Because of the possibility of additional wadding, encapsulating material, or the like, and to avoid any confusion regarding the scope of the claims, as such items are argued as being "projectiles" various claims may identify a lack of a substantial or effective projectile by defining a maximum mass of any item which could be asserted as a projectile. Where dimensions are given in both English and metric units, the English units are the original value and the metric units are a conversion.

One or more embodiments of the present invention have been described. Nevertheless, it will be understood that various modifications may be made without departing from the spirit and scope of the invention. For example, although various preferred dimensions have been identified, there remains flexibility in choosing the particular dimensions of a particular cartridge. If compatibility with the preferred cartridge (or with any particular cartridge) is desired, then flexibility in certain of the dimensions may be highly limited. Accordingly, other the scope of the following claims.

What is claimed is:

1. A ammunition in combination with a discharging apparatus for firing such ammunition wherein:

the discharging apparatus comprises:
- a chamber for receiving the ammunition;
- a muzzle; and
- a barrel between the chamber and the muzzle; and the ammunition extends from a rear end to a front end and comprises:
- a metallic case that:
  - extends aft-to-fore from a base at the ammunition rear end to a mouth;
  - has interior and exterior surfaces;
  - has a central longitudinal channel extending forward from a primer pocket portion at the base to a fore portion proximate the mouth; and
  - has a length and diameter effective to be initially accommodated within the chamber and then, after firing, to be driven forward into the barrel and discharged therefrom by such firing of a subsequent similar ammunition;
- a cover formed of polymeric resin and extending from a rear rim to a front end at the ammunition front end and having a mass not in excess of a mass of the case and having interior and exterior surfaces;
- a primer mounted within the primer pocket; and
- a propellant charge confined within a volume at least partially defined by the central longitudinal channel and the cover interior surface.

2. Ammunition in combination with a discharging apparatus for firing such ammunition wherein:

the discharging apparatus comprises:
- a chamber for receiving the ammunition;
- a muzzle; and
- a barrel between the chamber and the muzzle; and the ammunition extends from a rear end to a front end and comprises:
- a metallic case that extends aft-to-fore from a base at the ammunition rear end to a mouth and has interior and exterior surfaces, the metallic case having a case length and diameter effective to be initially accommodated within the chamber and then, after firing, to be driven forward into the barrel and discharged therefrom by such firing of a subsequent similar ammunition;

a cover formed of polymeric resin and extending from a rear rim to a front end at the ammunition front end and having a cover length greater than the case length having a mass not in excess of a mass of the case and having interior and exterior surfaces; and a propellant charge confined within a volume at least partially defined by a combination of said case and said cover.

3. The combination of claim 2 wherein:

the cover consists essentially of injection molded high density polyethylene; and the case consists essentially of die cast zinc or zinc alloy.

4. Ammunition in combination with a discharging apparatus for firing such ammunition wherein:

the discharging apparatus comprises:

a chamber for receiving the ammunition;

a muzzle; and a barrel between the chamber and the muzzle; and the ammunition extends from a rear end to a front end and comprises:

a metallic case that extends aft-to-fore from a base at the ammunition rear end to a mouth and has interior and exterior surfaces, the metallic case having a length and diameter effective to be initially accommodated within the chamber and then, after firing, to be driven forward into the barrel and discharged therefrom by such firing of a subsequent similar ammunition;

a cover formed of polymeric resin and extending from a rear rim to a front end at the ammunition front end and having a mass not in excess of a mass of the case and having interior and exterior surfaces, the cover interior surface having a circumferential recess forward of the case and effective to locally weaken the cover sufficiently to permit internal pressure within the cover to sever a portion ahead of the recess from a portion behind the recess while the portion behind remains attached to the case when the ammunition is fired; and a propellant charge confined within a volume at least partially defined by a combination of said case and said cover.

5. The combination of claim 4 wherein the circumferential recess:

has a longitudinal extent of between 1 mm and 5 mm; and locally thins the cover to a minimum thickness of between 0.6 mm and 1.4 mm from an adjacent thickness of between 1.6 mm and 2.6 mm.

6. In an ammunition round for use with a discharging apparatus that includes a chamber for receiving the ammunition, a muzzle and a barrel between the chamber and the muzzle, wherein the case of one round fired by the apparatus serves as a projectile expelled by ignition of the propellant charge contained within the case of the next round, the improvement wherein:

the case is formed of a cast zinc or a cast zinc-based alloy that extends aft-to-fore from a base to a mouth and has interior and exterior surfaces;

the primer is mounted in the case; and a member cooperates with the case to enclose the propellant charge the case exterior surface has a plurality of interspersed circumferential grooves and ribs, the ribs having a diameter effective to engage rifling of the barrel.

7. The ammunition of claim 6 wherein there are at least eight said grooves occupying a total of at least about 25% of a length of the case.

8. The ammunition of claim 6 wherein the plurality of grooves have widths of between 0.9 mm and 1.8 mm peak depths of between 0.08 mm and 0.30 mm from a maximum case diameter and, along with said ribs extend along at least 70% of the case length.

9. The ammunition of claim 8 wherein said peak depths are between 0.13 mm and 0.23 mm and said interspersed ungrooved areas have diameters within 0.05 mm of the maximum case diameter.

10. The ammunition of claim 8 having dimensions effective for projection from an industrial ballistic tool barrel having rifling with a land-to-land diameter which is 0.943–0.950 in and a grove-to-groove diameter which is 0.954–0.960 in.

11. The ammunition of claim 8 wherein the case exterior surface has circumferential extractor groove having a depth of at least 1 mm and separated by no more than 2 mm from an aft extremity of the case.

12. The ammunition of claim 6 wherein the member is a cap extending from a rear rim to a front end and having a rear portion encircling a fore portion of the case.

13. The ammunition of claim 12 wherein:

the cap is formed of a resinous polymer;

the case fore portion includes a flange having an external flange diameter;

the cap rear portion includes an inwardly directed part aft of the flange and having an internal diameter less than the flange diameter so as to cooperate with the flange to resist forward translation of the cap relative to the flange; and a cap length is between 100% and 300% of a case length.

14. The ammunition of claim 13 wherein:

there is a first radial clearance of at least 1.0 mm between the flange and the cap; and there is a second radial clearance of between interference fit and 0.5 mm between the cap inwardly directed part and a neck portion of the case aft of the flange.

15. The ammunition of claim 6 wherein the member is a cover having a reduced thickness portion effective so that upon the firing of the propellant charge of a given round a first portion of the cover ahead of the reduced thickness portion will be severed form a second portion aft of the reduced thickness portion and travel behind the spent case of the prior ammunition round.

16. The ammunition of claim 6 wherein the primer is a #209 primer press fit within a head portion of the cast zinc or cast zinc-based alloy case.

* * * * *